US005595117A

United States Patent [19]

Chrigui

[11] Patent Number: 5,595,117

[45] Date of Patent: Jan. 21, 1997

[54] METHOD AND APPARATUS FOR DAMPING BENDING VIBRATIONS OF CYLINDERS IN A PRINTING PRESS

[75] Inventor: Jilani Chrigui, Creil, France

[73] Assignees: Heidelberger Druckmaschinen AG, Heidelberg, Germany; Heidelberg Harris, S.A., Montataire, France

[21] Appl. No.: 511,176

[22] Filed: Aug. 4, 1995

[30] Foreign Application Priority Data

Aug. 9, 1994 [FR] France ..... 94 09853

[51] Int. Cl.[6] ..... B41F 5/00

[52] U.S. Cl. ..... 101/216; 101/212

[58] Field of Search ..... 101/212, 216, 101/480; 74/574, 604

[56] References Cited

U.S. PATENT DOCUMENTS 4,640,190 2/1987 Holzapfel ..... 101/348
4,739,702 4/1988 Kobler .
5,226,365 7/1993 Wieland .
5,235,909 8/1993 Gerstenberger et al. .

*Primary Examiner*—John S. Hilten
*Attorney, Agent, or Firm*—Kenyon & Kenyon

[57] ABSTRACT

A method and apparatus for damping bending vibration in a group of cylinders in a printing press is provided. In accordance with the method, the frequencies of the fundamental vibration modes are initially determined and then dynamic dampers are disposed so as to damp the vibrations. In accordance with the apparatus, at least one dynamic damper is disposed inside the envelope of a cylinder in the group of cylinders. It may be formed as a mass held elastically inside the envelope and having a vibration frequency that corresponds to the frequency of a fundamental vibration mode of the group of cylinders.

15 Claims, 5 Drawing Sheets

1
3
2
2
3
11
VI
VI
19
6
7
7
7
7

METHOD AND APPARATUS FOR DAMPING BENDING VIBRATIONS OF CYLINDERS IN A PRINTING PRESS

FIELD OF THE INVENTION

The present invention relates to a method and apparatus for damping bending vibrations of cylinders in a print assembly of a printing press.

BACKGROUND OF THE INVENTION

During the printing process, surface zones of the cylinders in a printing assembly move by rolling on one another. Since these surface zones are not themselves closed, but include channels in which the ends of a blanket or of a printing plate are securely clamped, contact pressure between the cylinders varies during the machine cycle. In particular, at high machine speeds, vibration is caused by the periodic appearance of imbalances and by the periodic variation in contact pressure. Such vibration can be seen in the printed image in the form of stripes, with the quality of printing being degraded because of variation in optical density.

Optimization, i.e. relatively high degrees of stabilization of contact pressure within one rotation of the machine is obtained by inserting "Schmitz rings", also known as "cords". These serve, advantageously, to stiffen the connections between cylinders in a printing assembly, without reaching permissible stress limits. The advantage of cords lies in increasing the frequency of the stripes and in reducing the amplitude of the stripes. However, at high speeds, stripes continue to appear, printing quality becomes unacceptable, and cords thus become inadequate.

Various devices are known in the state of the art for reducing twisting and bending vibration of cylinders in the print assemblies of a printing press. Document DE-C1-3 527 711 describes a print cylinder which includes a device for reducing twisting and bending vibration caused by channel overlaps by using at least one damping element disposed for this purpose in the cylinder of the print assembly. The damping element is effectuated by a transverse element fixed to the bottom portion of the envelope of said cylinder of the print assembly and by means of the shocks that occur in the gaps of the cylinder as it rolls over the channels. In addition, a point of contact is provided beneath the envelope of the cylinder on which the damping element can be effectuated in complementary manner while rolling on the channels.

Another structure for damping vibration in print cylinders is known from document DE-C1-4 119 825. A body that is symmetrical about the axis of rotation and that is positioned inside the cylinder forms a countermass to the envelope of the cylinder. As this internal body is symmetrical about the axis of rotation, it is surrounded by vibration-damping material. This structure thus provides a reduction in the amplitude of cylinder bending vibration which appears as a result of the shocks that take place in the gaps of the cylinder.

Document DE-C1-4 033 278 describes a bending vibration damper designed for a cylinder of a rotary printing press. A damper tuned over a broad frequency band is disposed in a special manner inside a cylinder of the print assembly, with the natural frequency of said damper corresponding to the frequency of oscillation of the cylinder of the print assembly. By having the damper deflect in phase opposition, the amplitude of bending vibration of the cylinder of the print assembly as induced by passing over the channels is reduced, as are higher harmonics thereof.

SUMMARY OF THE INVENTION

The present invention provides a method and apparatus for reducing in reliable manner the bending vibration in a group of cylinders in a print assembly of a printing press.

In accordance with the method according to the present invention, the frequencies of the fundamental vibration modes are determined, and dampers are disposed in such a manner as to damp said frequencies of the fundamental modes of the group of cylinders.

Advantageously, the method according to the present invention proposes two ways of determining the fundamental vibration modes of the group of cylinders in a print assembly.

In accordance with a first embodiment of the method of the present invention, the fundamental vibration modes are evaluated from a mathematical model.

In accordance with a second embodiment of the method of the present invention, the fundamental vibration modes for each constellation of parameters are determined and correlated experimentally.

Dynamic, digital, and experimental analyses have shown that the main reason for bending vibration of the cylinders is passing over the channels.

Mathematically, the resonant frequencies and the bending amplitudes that correspond to the fundamental vibration modes can be determined by means of a three-dimensional model. In particular, the model serves to calculate the eigen values of the mass matrix and of the stiffness matrix. In the model, the stiffnesses of contact pressures, of the bearings, and of the gearing are represented by equivalent springs. The shapes of the channels and the state of the material are represented in the digital model.

Experimental investigations have shown that in a rotary press printing on a strip, vibration coming from the rolling motion of two blanket-carrying cylinders one on another gives rise to the largest disturbance. In accordance with a further embodiment of the method of the present invention, the mode defined as the fundamental mode of vibration in a rotary press for printing on a strip and having both an upper print assembly and a lower print assembly is the mode in which the cylinders of the upper print assembly are in phase opposition relative to the cylinders of the lower print assembly.

In accordance with another embodiment of the method of the present invention the mode defined as the fundamental vibration mode is the mode in which the cylinders of the upper print assembly and also the cylinders of the lower print assembly are in phase opposition to one another. Consequently, either the blanket-carrier cylinder and the plate-carrier cylinder of the upper print assembly and of the lower print assembly are in phase opposition relative to each other, and/or the blanket-carrier cylinders and the plate-carrier cylinders of the upper print assembly or of the lower print assembly, respectively, are in phase opposition.

In accordance with the apparatus of the present invention, optimum damping of the vibration in a group of cylinders of a print assembly for a rotary press that prints on a strip may be achieved by one of the following three constellations:

a dynamic damper is installed inside the blanket-carrier cylinders of the upper print assembly and of the lower print assembly, having the natural frequency of the fundamental vibration mode, such that the fundamental vibration mode defines the mode in which the cylinders of the upper print assembly and also the cylinders of the lower print assembly are in phase opposition relative to one another;

a dynamic damper is installed inside the plate-carrier cylinders of the upper print assembly and of the lower print assembly, having the natural frequency of the fundamental vibration mode, such that the fundamental vibration mode defines the mode in which the cylinders of the upper print assembly are in phase opposition relative to the cylinders of the lower print assembly;

a dynamic damper is installed inside the plate-carrier cylinders of the upper print assembly and of the lower print assembly, having the natural frequency of the fundamental vibration mode, such that the fundamental vibration mode defines the mode in which the cylinders of the upper print assembly are in phase opposition relative to the cylinders of the lower print assembly, and also a dynamic damper is installed inside the blanket-carrier cylinders of the upper print assembly and of the lower print assembly, having the natural frequency of the fundamental vibration mode, such that the fundamental vibration mode defines the mode in which the cylinders of the upper print assembly and also the cylinders of the lower print assembly are in phase opposition relative to each other.

In accordance with the apparatus according to the present invention, at least one dynamic damper constituted by a mass-forming element elastically disposed inside cylinders is provided, whose vibration frequency corresponds to the frequency of a fundamental vibration mode of the group of cylinders.

The dynamic damper may advantageously be disposed in the central zone of the cylinder since that is where bending vibration has maximum amplitude. In addition, the dynamic damper may be disposed in such a manner as to be substantially symmetrical about the axis of rotation of the cylinder.

According to a further embodiment of the apparatus of the present invention, the massforming element is connected via elastic link elements to the inside surface of the envelope of the cylinder. These elastic link elements may be springs, for example. However, it is also possible to dispose the mass-forming element inside a material that is compressible.

In accordance with a still further embodiment of the apparatus of the present invention, the mass-forming element is a cylindrical body. In order to achieve optimum adjustment of the vibration damping mass relative to respective conditions, the exemplified embodiment of the invention provides for a cylindrical body with a bore having an inside thread and serving to receive a correction pin. This makes it possible to optimize the mass of the damping cylindrical body as a function of the total vibrating mass.

DETAILED DESCRIPTION

Figure 1:
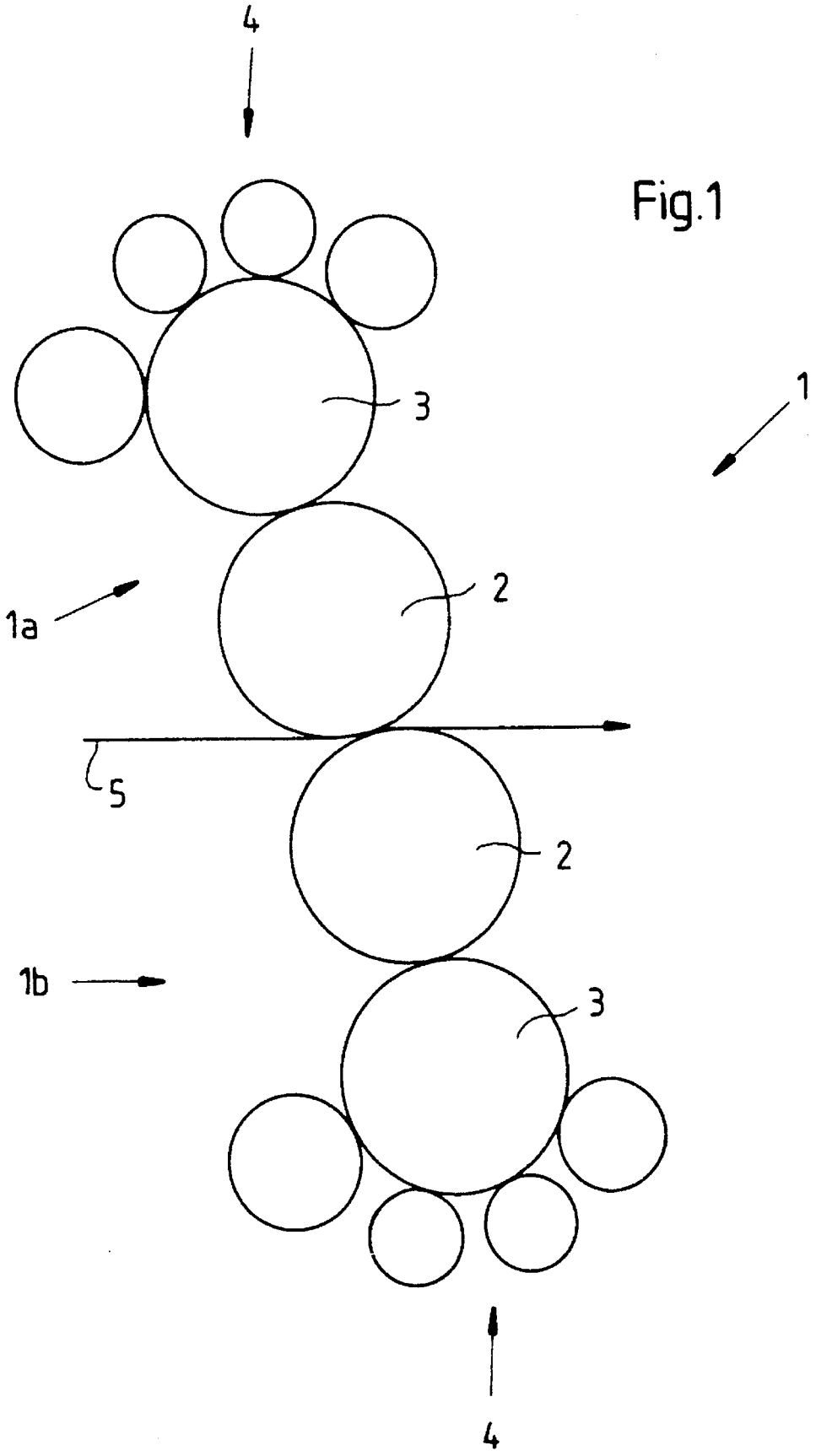
FIG. 1 is a diagram representing a group of cylinders in a press for printing on a strip.

FIG. 1 is a diagrammatic view of one possible disposition of cylinders in a print assembly 1 that is situated in a rotary press for printing a strip (which press is not shown separately). Each print assembly 1, in the present case an upper print assembly 1*a* and a lower print assembly 1*b*, is constituted by a blanket-carrier cylinder 2 and a plate-carrier cylinder 3. The inking rollers adjacent to the plate-carrying cylinder 3 form a part of the inking assembly 4. The strip 5 is printed between the two blanket-carrier cylinders 2 of the upper and lower print assemblies 1*a* and 1*b*.

The blanket-carrier cylinders 2 and the platecarrier cylinders 3 have channels that serve to clamp securely onto the ends of blankets or of printing plates, respectively. The channels situated in the cylinders 2 and 3 disturb the rolling of the cylinders 2 and 3 that are mutually in contact. Consequently, if the channels of the blanket-carrier cylinders 2 or the channels of the blanket-carrier cylinder 2 and the plate-carrier cylinder 3 come into contact, then shocks occur. These shocks excite vibration modes of the group of cylinders.

The amplitudes of the vibrations are influenced by various factors. Firstly, for example, by the stiffness of the cylindrical configuration of the vibrating mass, and secondly by the machine speed which is a criterion that is becoming more and more important. Because of marks in the form of stripes in the printed image, for example, which are transferred in a rotary press for printing on a strip by the blanket-carrier cylinders 2 onto both sides of the strip 5, these vibrations become negatively perceptible. In particular, the stripes existing in the printed image reflect bounces of the cylinders 2 and 3 which give rise during transfer onto the strip 5 to variations in the optical density of the ink. The wavelength of the stripes is a linear function of printing speed. The natural vibration frequency can be determined on the basis thereof without difficulty.

FIGS. 2*a* to 2*d* show the four fundamental vibration modes of a four-cylinder configuration for a print assembly 1 of a press for printing on a strip. In this cylindrical configuration, four resonant frequencies $f_i$ are associated with the four fundamental vibration modes $M_i$. In the figures, the following modes $M_i$ are shown in detail.

Figure 2B:
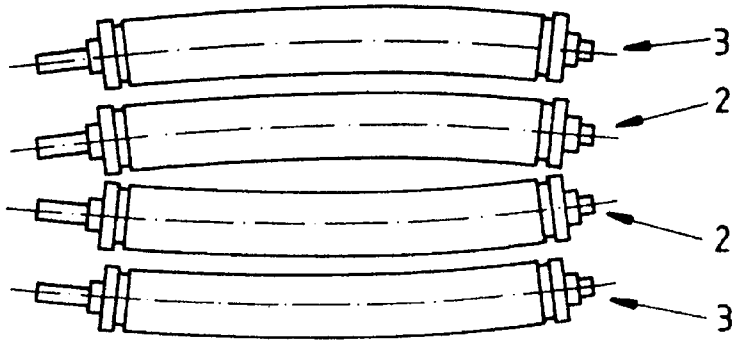
FIGS. 2*a* to 2*d* are views showing four fundamental vibration modes of the group of cylinders in a press for printing on a strip.
Figure 2D:
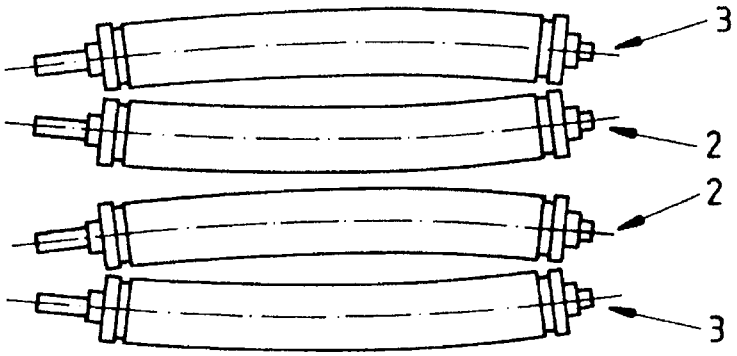
Figure 2A:
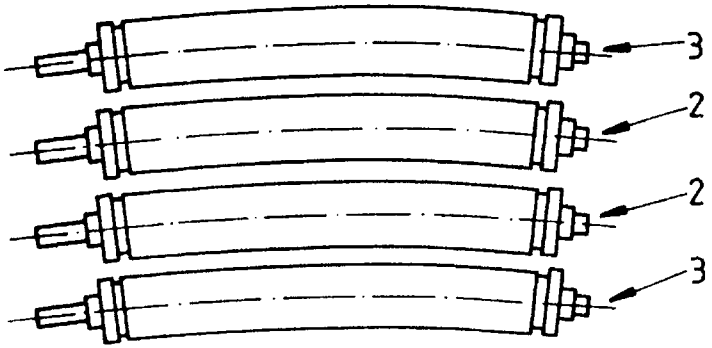

FIG. 2*a* shows a fundamental vibration mode M1 in which the plate-carrier cylinders 3 and the blanket-carrier cylinders 2 of the upper print assembly 1*a* and of the lower print assembly 1*b* are in-phase. In this fundamental vibration mode $M_1$, no vibration is induced while passing over the channels.

FIG. 2*b* shows a fundamental vibration mode $M_2$ in which the blanket-carrier cylinder 2 and the plate-carrier cylinder 3 of the upper print assembly 1*a* are in phase opposition relative to the blanket-carrier cylinder 2 and the plate-carrier cylinder 3 of the lower print assembly 1*b*. This fundamental mode of vibration $M_2$ has a natural frequency which is written $f_2$.

Figure 2C:
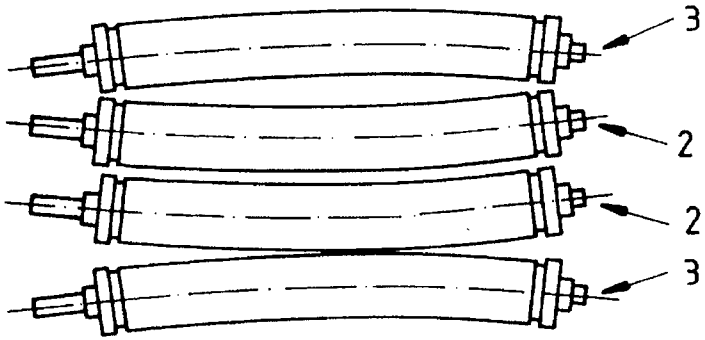

A fundamental vibration mode $M_3$ is shown in FIG. 2*c*. The blanket-carrier cylinders 2 of the upper and lower print assemblies 1*a* and 1*b* are in-phase, whereas the plate-carrier cylinders 3 of the upper and lower print assemblies 1*a* and 1*b* are in phase opposition relative to the blanker-carrier cylinders 2. In this case, since the blanket-carrier cylinders 2 and the plate carrier cylinders 3 are respectively in phase, the natural frequency $f_3$ of fundamental vibration mode $M_3$ is not excited.

FIG. 2*d* shows a fundamental vibration mode $M_4$ in which the blanket-carrier cylinders 2 of the upper and lower print assemblies 1*a* and 1*b* are in phase opposition to each other, and also, in both cases, the blanket-carrier cylinder 2 and the plate-carrier cylinder 3 of each of the upper and lower print assemblies 1*a* and 1*b* are mutually in phase opposition.

As mentioned above, it is rolling over the channels between the blanket-carrier cylinders 2 in phase opposition that is the main source of excitation for vibration. Consequently, the fundamental vibration modes $M_2$ and $M_4$ and the corresponding frequencies $f_2$ and $f_4$ are of particular importance. In advantageous implementations of the method of the present invention, and embodiments of the apparatus of the present invention, compensating the natural frequencies $f_2$ and $f_4$ which correspond to the fundamental vibration modes $M_2$ and $M_4$ is of particular importance.

Dynamic shock absorbers 6 may be integrated in three different ways inside the cylinder configuration shown:

dynamic dampers 6 having a natural frequency $f_4$ can be placed in both blanket-carrier cylinders 2; or dynamic dampers 6 having natural frequency $f_2$ can be disposed inside the two plate-carrier cylinders 3; or else, as a further possibility dynamic dampers 6 having natural frequency $f_2$ can be disposed inside both plate-carrier cylinders 3 and dynamic shock absorbers having natural frequency $f_4$ can be installed inside the blanket-carrier cylinders 2.

Figure 3:
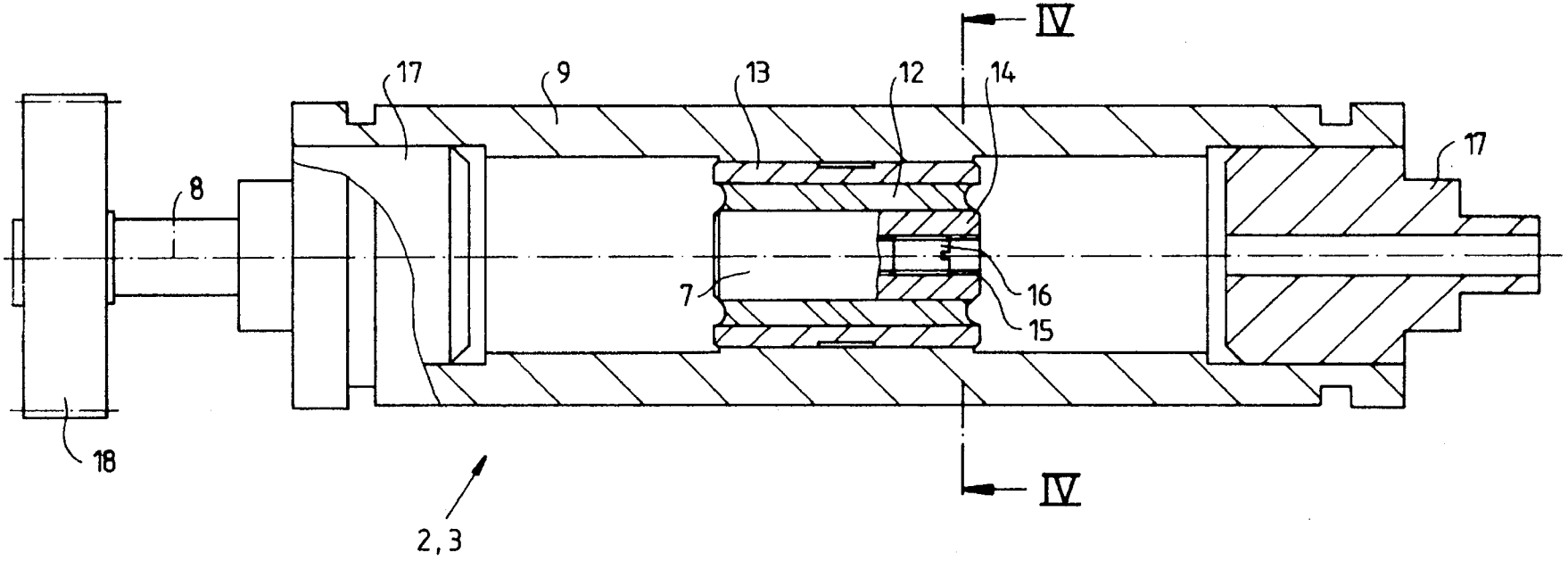
FIG. 3 is a view showing one embodiment of apparatus of the present invention.

FIG. 3 shows a first embodiment of an apparatus according to the present invention. The cylinders 2 and 3 have a hollow internal portion. The dynamic damper 6 is disposed in the central zone of the cylinders 2, 3 substantially symmetrically about the axis of rotation 8 of the cylinders 2, 3. As described herein, the dynamic damper 6 is constituted by a tube 13 and, as shown, by a mass-forming element 7 that is in the form of a cylinder that is coated in a compressible material 12, and that is disposed inside the tube 13. The tube 13 is itself securely fixed in the cylinders 2, 3. In FIG. 3, the mass-forming element 7 is constituted more particularly by a cylindrical body 14. This structure has turned out to be more advantageous than welded structures or spot welded structures since imbalances appearing between the tube 13 and the inside surface of the envelope 9 of the cylinder are minimized. Advantageously, the cylindrical body 14 includes a bore having an inside thread 15, enabling a correction pin 16 to be received for the purpose of tuning the resonant frequency.

In the same manner as the dynamic damper 6 situated inside the cylinders 2, 3, stub axles 17 are securely connected to the inside of the envelope 9 of each cylinder. The ends of the stub axles 17 carry bearings that are not shown herein. In order to position the correction pins 16 in the dynamic damper 6 from the outside, the stub axles are hollow along their entire length. Alternatively, at least the stub axle at one end is hollow, preferably the end that is accessible to an operator.

Figure 4:
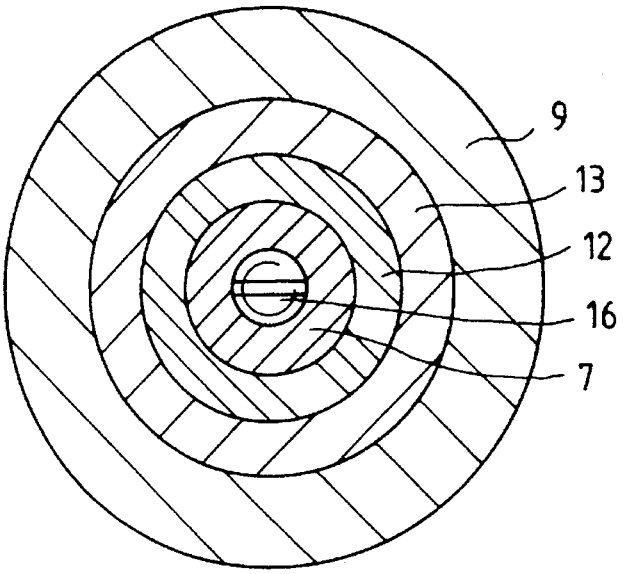
FIG. 4 is a section view on line IV—IV of FIG. 3.

FIG. 4 is a section view on line IV—IV of FIG. 3. The dynamic damper 6 constituted by a tube 13, by compressible material 12, by the mass-forming element 7, and by the correction pin 16 is securely connected to the inside of the envelope 9 of the cylinder. The main function of the damper 6, is, in this case, to absorb the vibratory energy created by the cylinders 2, 3 during the first period of vibration. Since the elements 7 forming a vibrating mass (i.e. in the above-described case, the mass-forming element encased in vibration-absorbing compressible material 12) are tuned optimally to the resonant frequencies of the cylinder configuration, a highly effective damper of their vibrations is obtained.

Figure 5:
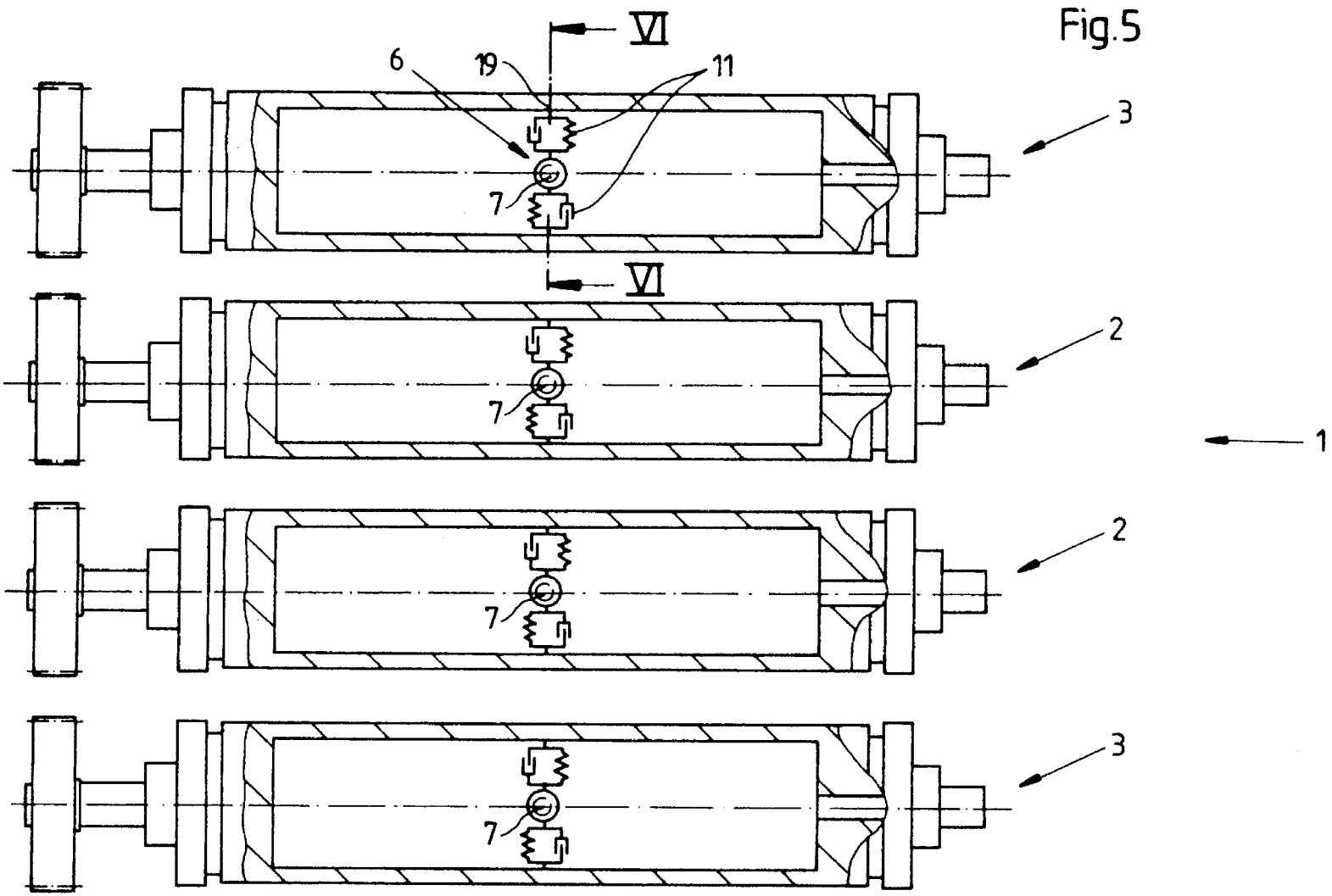
FIG. 5 is a view showing another embodiment of apparatus of the present invention.

FIG. 5 shows another particular embodiment of the apparatus of the present invention. In FIG. 5, all four cylinders are shown specifically, i.e. both blanket-carrier cylinders 2 and both plate-carrier cylinders 3 of a print assembly 1 in a rotary press for printing on a strip. As in the previously described embodiment, here also the cylinders 2, 3 have hollow insides. The cylinders 2, 3 are connected to one another by means of Schmitz rings. Since the bearings of a cylinder and the Schmitz rings serve to stiffen the configuration of the cylinder, the cylinders 2, 3 flex most in their central zones. That is why the dynamic damper 6 should be placed wherever possible in the central zone of each cylinder 2, 3.

Figure 6:
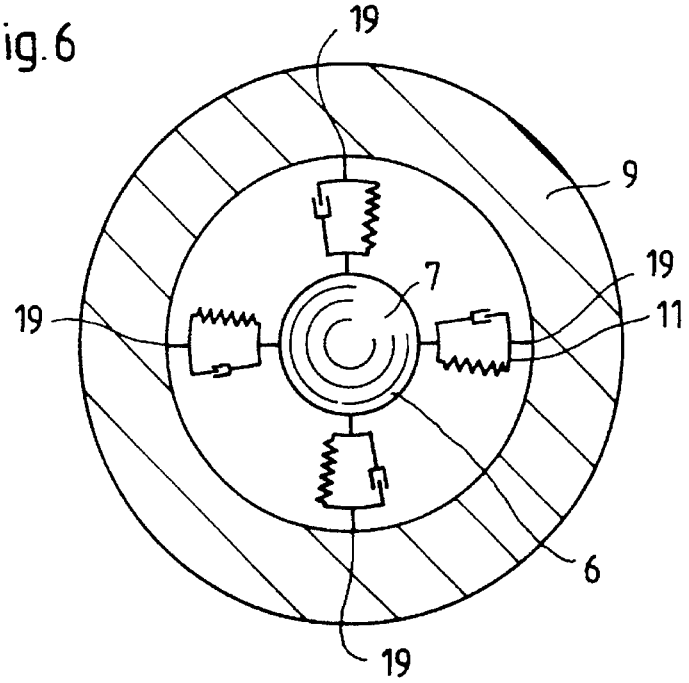
FIG. 6 is a section view on line VI—VI of FIG. 5.

In FIGS. 5 and 6, the dynamic damper 6 is somewhat altered in form. The damper 6 is constituted by a mass-forming element 7, which in the case shown is a ball, which is held in place inside the cylinders 2, 3 by elastic link elements 10, constituted herein by springs 11 and by viscous dampers (dash pots) 20.

The dynamic damper 6 which is connected to the inside surface of the envelope 9 of the cylinder via anchor points 19 is designed to vibrate while the printing press is in operation. Since its frequency of vibration can be tuned in optimum manner exactly to the natural frequency of the cylinder configuration of the print assembly 1, vibratory energy is practically completely transferred to the element 7 forming the vibrating mass. That is why the method and the apparatus of the present invention make it possible for bending vibration of the cylinder configuration in a print assembly to be damped almost completely. As a result, stripes in the printed image due to bending vibrations can be reduced to a minimum.

What is claimed is:

1. A method for damping bending vibrations in a group of cylinders situated in a print assembly of a printing press, the method comprising the steps of:

determining a frequency of at least one fundamental vibration mode; and disposing at least one dynamic damper such that said dynamic damper damps said frequency of the fundamental mode of said group of cylinders.

2. The method according to claim 1, wherein said determining step further comprises the step of determining the frequency of the at least one fundamental vibration mode utilizing a mathematical model.

3. The method according to claim 1, wherein said determining step further comprises the step of determining and correlating the frequency of the at least one fundamental vibration mode experimentally.

4. A method for damping bending vibrations in a group of cylinders situated in a print assembly of a printing press, the method comprising the steps of:

determining a frequency of at least one fundamental vibration mode, the at least one fundamental vibration mode being defined as a mode in which an upper blanket-carrier cylinder and an upper plate-carrier cylinder of an upper print assembly are in phase opposition relative to a lower blanket-carrier cylinder and a lower plate-carrier cylinder of a lower print assembly; and disposing at least one dynamic damper such that said dynamic damper damps said frequency of the fundamental mode of said group of cylinders.

5. The method according to claim 4, wherein the disposing step further comprises the step of disposing dynamic dampers in the upper plate-carrier cylinder of and the lower plate-carrier cylinder, said dynamic dampers having the same natural frequency as the at least one fundamental vibration mode.

6. A method for damping bending vibrations in a group of cylinders situated in a print assembly of a printing press, the method comprising the steps of:

determining a frequency of at least one fundamental vibration mode, the at least one fundamental vibration mode being defined as a mode in which an upper blanket-carrier cylinder and a upper plate-carrier cylinder of an upper print assembly are in phase opposition to each other and a lower blanket-carrier cylinder and a lower plate-carrier cylinder of a lower print assembly are in phase opposition to each other; and, disposing at least one dynamic damper such that said dynamic damper damps said frequency of the fundamental mode of said group of cylinders.

7. The method according to claim 6, wherein the disposing step further comprises the step of disposing dynamic dampers in the upper blanket-carrier cylinder and the lower blanket carrier cylinder, said dynamic dampers having the same natural frequency as the at least one fundamental vibration mode.

8. A method for damping bending vibrations in a group of cylinders situated in a print assembly of a printing press, the method comprising the steps of:

defining a first fundamental vibration mode as a mode in which an upper blanket-carrier cylinder and an upper plate-carrier cylinder of an upper print assembly are in phase opposition relative to a lower blanket-carrier cylinder and a lower plate-carrier cylinder of a lower print assembly;

defining a second fundamental vibration mode as a mode in which the upper blanket-carrier cylinder and the lower plate-carrier cylinder of the upper print assembly are in phase opposition to each other and the lower blanket-carrier cylinder and the lower plate-carrier cylinder of the lower print assembly are in phase opposition to each other;

determining a first frequency of the first fundamental vibration mode, and a second frequency of the second fundamental vibration mode; and disposing a first dynamic damper inside the upper plate-carrier cylinder and inside the lower plate-carrier cylinder, the first dynamic dampers having the same natural frequency as the first fundamental vibration mode;

disposing a second dynamic damper inside the upper blanket-carrier cylinder and inside the lower blanket-carrier cylinder, the second dynamic dampers having the same natural frequency as the second fundamental vibration mode.

9. An apparatus for damping bending vibration in a group of cylinders situated in a print assembly of a printing press, comprising:

at least one dynamic damper having a mass-forming element elastically disposed inside one of the cylinders, said mass-forming element having a vibration frequency corresponding to a frequency of a fundamental vibration mode of the group of cylinders.

10. The apparatus according to claim 9, wherein at least one dynamic damper is disposed in a middle zone of each cylinder of the group of cylinders, each dynamic damper being disposed substantially symmetrical about an axis of rotation of its respective cylinder.

11. The apparatus according to claim 9, further including one or more elastic link elements, the mass-forming element being connected via elastic link elements to an inside surface of a cylinder envelope.

12. The apparatus according to claim 11, wherein the elastic link elements are springs and viscous dampers.

13. The apparatus according to claim 11, wherein the elastic link element is made of a compressible material.

14. The apparatus according to claim 11, wherein the mass-forming element is formed as a cylindrical body.

15. The apparatus according to claim 14, wherein the cylindrical body includes a bore having an inside tapping for receiving a correction pin.

* * * * *